United States Patent [19]

Capes et al.

[11] Patent Number: 4,592,506

[45] Date of Patent: Jun. 3, 1986

[54] WEAR RESISTANT ATOMIZING NOZZLE ASSEMBLY

[75] Inventors: Charles E. Capes; Adam J. Bennett, both of Ottawa; Kevin A. Jonasson, Orelans; William L. Thayer, Ottawa, all of Canada

[73] Assignee: Canadian Patents and Development Limited, Ottawa, Canada

[21] Appl. No.: 685,145

[22] Filed: Dec. 21, 1984

[30] Foreign Application Priority Data

Jan. 4, 1984 [CA] Canada ..... 444624

[51] Int. Cl.[4] ..... B05B 1/24

[52] U.S. Cl. ..... 239/139; 239/424; 239/505; 239/518; 239/DIG. 19

[58] Field of Search ..... 239/132.1, 133, 135, 239/139, 420, 424, 426, 505, 518, 520, DIG. 19, 524

[56] References Cited

U.S. PATENT DOCUMENTS

| | | | |
|---|---|---|---|
| 1,688,827 | 10/1928 | Nelson | 239/524 |
| 2,009,932 | 7/1935 | Klotzman | 239/DIG. 19 |
| 3,741,484 | 6/1973 | Cresswell | 239/424 |
| 3,923,248 | 12/1975 | Cresswell | 239/424 |
| 4,220,283 | 9/1980 | Citron | 239/518 |
| 4,235,379 | 11/1980 | Beamer | 239/600 |
| 4,361,285 | 11/1982 | Koppehele et al. | 230/424 |

FOREIGN PATENT DOCUMENTS

| | | | |
|---|---|---|---|
| 763490 | 5/1934 | France | 239/DIG. 19 |
| 2262 | of 1888 | United Kingdom | 239/132.1 |

OTHER PUBLICATIONS

Fluid Kinetics, Inc., Brochure No. DX1277-2-"Flosonic Supersonic Atomization", Dec. 1977.

*Primary Examiner*—Jeffrey V. Nase
*Assistant Examiner*—Michael J. Forman
*Attorney, Agent, or Firm*—Francis W. Lemon

[57] ABSTRACT

A wear resistant atomizing nozzle assembly is provided having an outwardly diverging, frustum of a cone-shaped deflector core of wear resistant ceramic and a nozzle rim of wear resistant ceramic and having an outwardly flared inner surface encircling the core to form a flared, atomizing nozzle orifice therewith. The core is mounted in a flared socket of a deflector core holder and inner and outer sleeves feed, say, atomizing air to the deflector core surface and, say, a coal liquid mixture fuel inwardly around the nozzle rim so that the fuel is held by the air as a film against the nozzle rim inner surface and then atomized as it emerges from the nozzle rim.

4 Claims, 5 Drawing Figures

WEAR RESISTANT ATOMIZING NOZZLE ASSEMBLY

Figure 1:
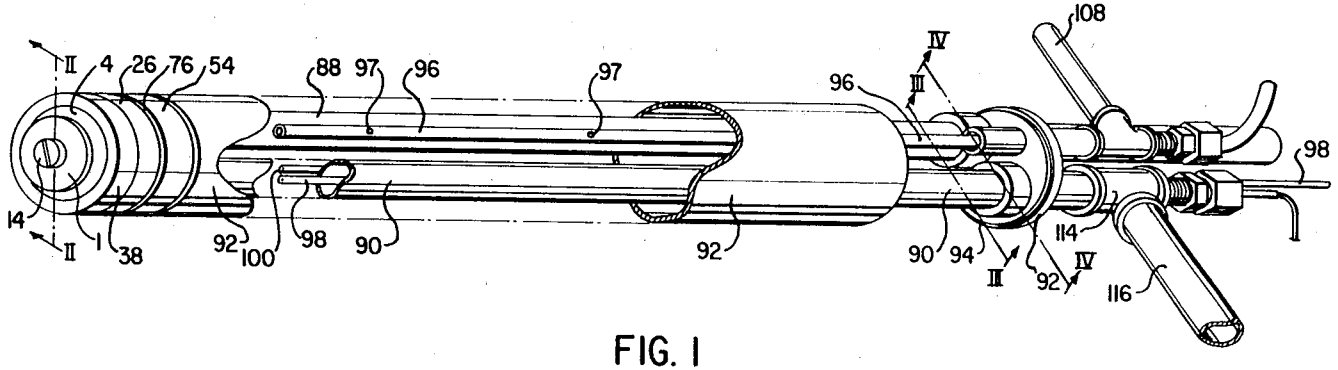

This invention relates to a wear resistant, atomizing nozzle assembly.

It has already been proposed in U.S. Pat. No. 3,419,220, dated Dec. 31, 1968, "Nozzles for Abrasive-Laden Slurry", R. J. Goodwin et al, to provide a nozzle made of two or more parts of different materials such as diamond, ceramic materials, boron carbide and tungsten carbide, so that the entrance section has high resistance to wear from impact while the exit section has high resistance to wear from abrasion.

While the Goodwin et al nozzle is useful in, for example, hydraulic jet drilling, there is a need for a wear resistant atomizing nozzle which will atomize a liquid by means of an atomizing fluid stream.

According to the present invention there is provided a wear resistant, atomizing nozzle assembly comprising:

(a) an outwardly diverging, frustum of a cone shaped, deflector core of a wear resistant ceramic material, an outer portion of the diverging surface of the deflector core forming an outwardly deflecting surface for a liquid-to-be-atomized, (b) a nozzle rim of a wear resistant ceramic material, the rim having an outwardly flared inner surface encircling the diverging surface of the deflector core to form therewith a flared, atomizing nozzle orifice, (c) a deflector core holder having a flared socket at a leading end, the flared socket having an inner portion of the deflector core closely fitting and aligned therein, the flared socket, in operation, guiding atomizing fluid towards and along the outwardly deflecting surface of the deflector core, (d) securing means securing the deflector core in the flared socket, (e) an inner sleeve having an inner end closely fitted on an inner end of the deflector core holder and having a leading, lengthwise extending end portion with an enlarged bore and terminating at an intermediate position along the length of the flared socket to form a fluid passage around the deflector core holder for, in operation directing a jet of atomizing fluid along the outer surface of the flared socket and towards and along the outwardly deflecting surface of the deflector core, (f) an outer sleeve mounted at a rear end on the inner sleeve and having a stepped, annular recessed portion at the leading end with the nozzle rim mounted therein and protruding radially inwardly therefrom, a portion of the outer sleeve member having a relatively larger bore diameter than the outside diameter of the inner sleeve and forming therewith a liquid-to-be-atomized passage therearound, for, in operation, conveying liquid-to-be-atomized towards an innerside face of, and inwardly around, the inward protrusion of the nozzle rim, (g) means securing the nozzle rim in the stepped, annular recess, (h) means for delivering atomizing fluid to the fluid passage, and (i) means for delivering liquid-to-be-atomized to the liquid-to-be-atomized passage.

In some embodiments of the present invention a bulkhead is connected to the inner and outer sleeves and having passages therethrough for passing atomizing fluid to the means for delivering atomizing fluid and liquid-to-be-atomized to the means for delivering liquid-to-be-atomized, a tubular casing is connected to the bulkhead and extending rearwardly therefrom, a casing flange seals the rear end of the tubular casing, an atomizing fluid supply pipe extends through the casing flange along the casing interior and is connected to the bulkhead to deliver fluid to the atomizing passage extending therethrough, and a liquid-to-be-atomized supply pipe extends through the casing flange along the casing interior and is connected to the bulkhead to deliver liquid to the liquid-to-be-atomized passage extending therethrough.

In other embodiments of the present invention, a steam supply pipe, with steam escape holes therealong for the escape of steam therefrom into the casing, the steam supply pipe extends through the casing flange and terminates with a closed end adjacent the bulkhead, and steam/condensate outlet means is attached to the casing flange for the removal of steam/condensate from the casing interior.

Preferably, the deflector core has an included angle in the range 60° to 90°.

Figure 2:
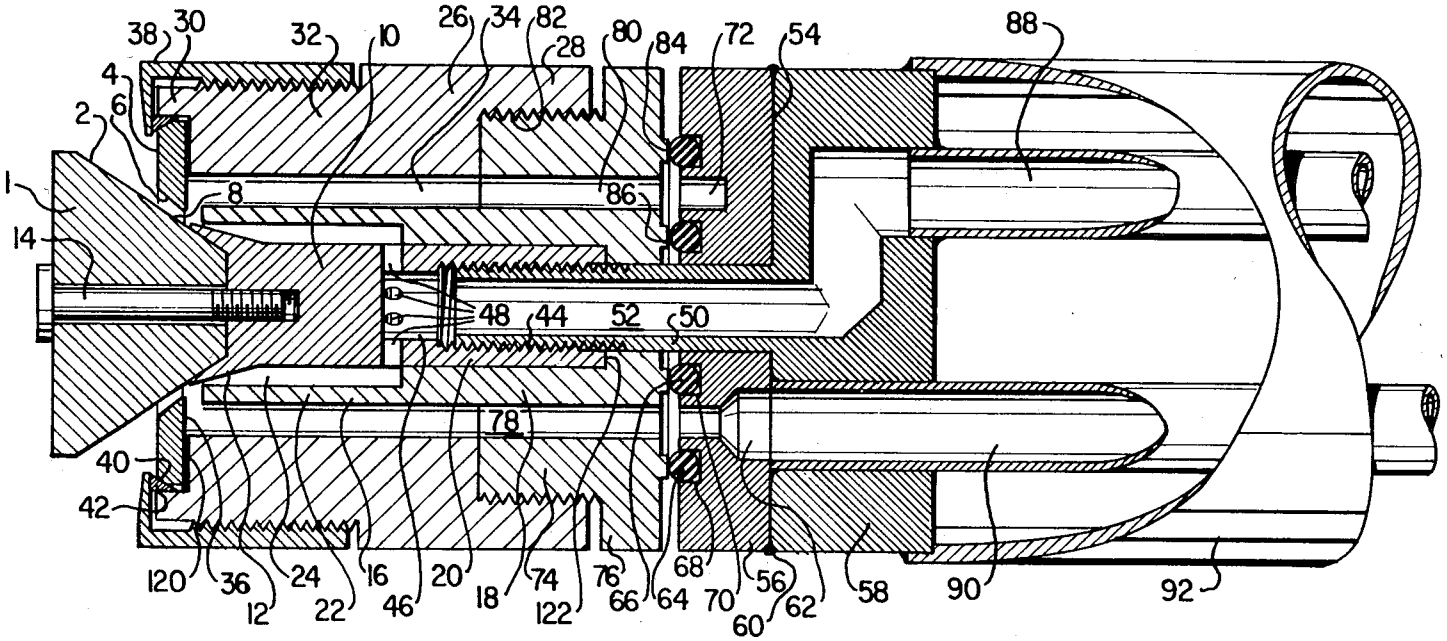
Figure 3:
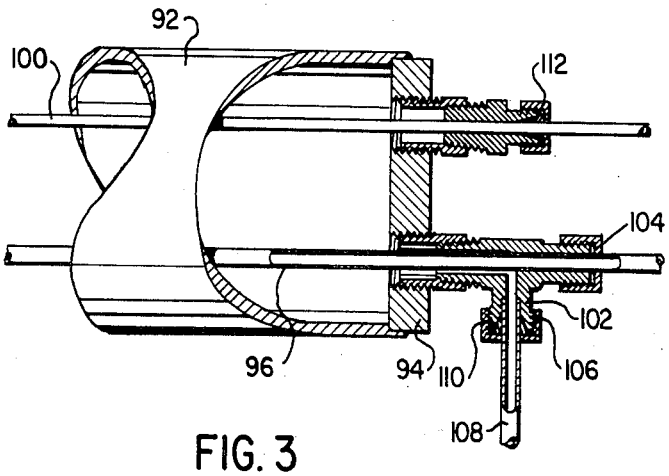
Figure 4:
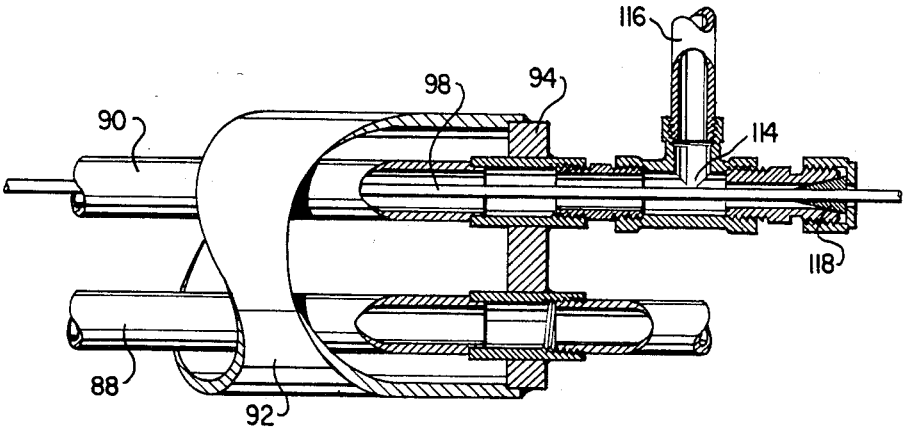
Figure 5:
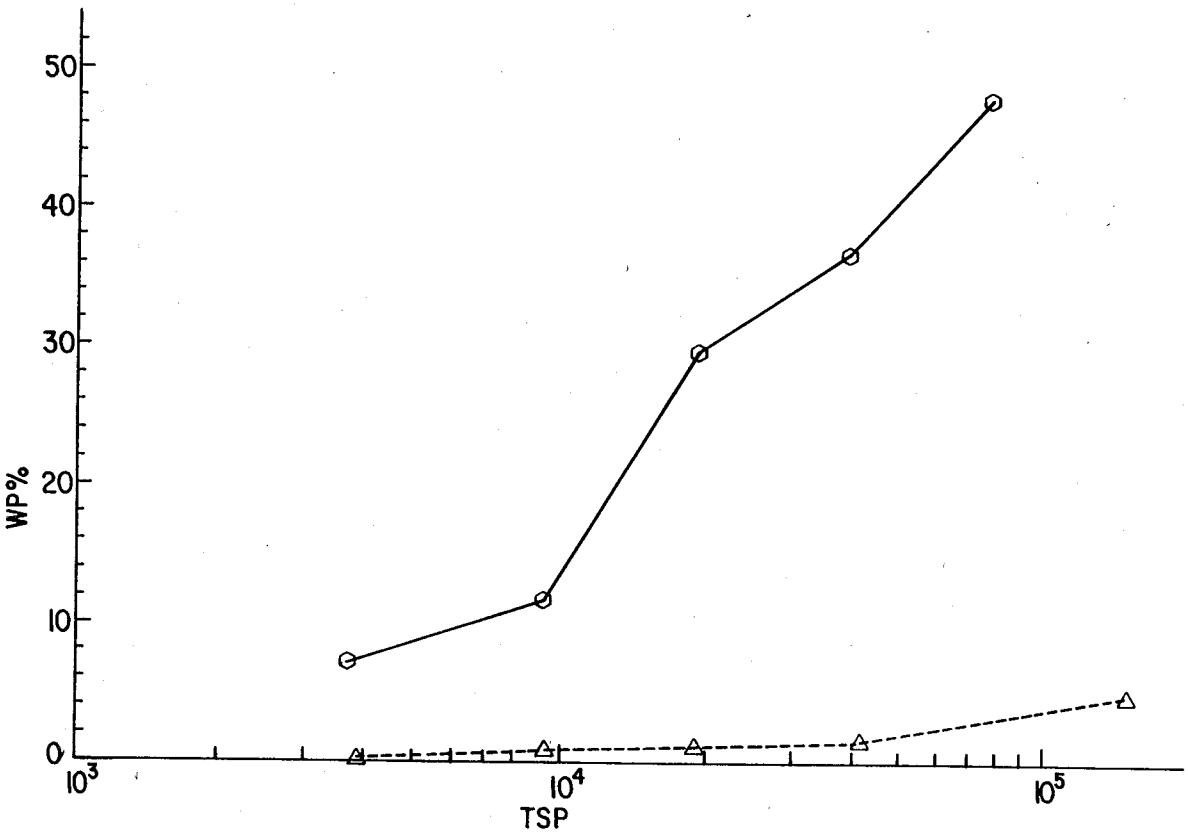

In the accompanying drawings which illustrate, by way of example, an embodiment of the present invention, FIG. 1 is a partly exploded, partly cut away, corner view of a wear resistant, atomizing nozzle assembly, FIG. 2 is a sectional side view along II—II, FIG. 1 of a nozzle, leading end portion of the nozzle assembly, FIG. 3 is a sectional side view along III—III, FIG. 1, of a rear, steam circulating portion of the nozzle assembly, FIG. 4 is a sectional side view along IV—IV, FIG. 1, of a rear fuel and atomizing fluid delivery portion of the nozzle assembly, FIG. 5 is a graph of test results, using the nozzle assembly shown in FIGS. 1 to 4, with the total solids discharge plotted against a wear parameter.

Referring now to FIGS. 1 and 2, there is shown a wear resistant, atomizing nozzle assembly comprising:

(a) an outwardly diverging, frustum of a cone shaped, deflector core 1 of a wear resistant ceramic material, an outer portion of the diverging surface of the deflector core 1 forming an outwardly deflecting surface 2 for a liquid-to-be-atomized, (b) a nozzle rim 4 of a wear resistant ceramic material, the rim having an outwardly flared inner surface 6 encircling the diverging surface 2 of the deflector core 1 to form therewith a flared, atomizing nozzle orifice 8, (c) a deflector core holder 10 having a flared socket 12 at a leading end, the flared socket 12 having an inner portion of the deflector core 1 closely fitting and aligned therein, the flared socket 12, in operation, guiding atomizing fluid towards and along the outwardly deflecting surface 2 of the deflector core 1, (d) securing means, in the form of a screw threaded bolt 14, securing the deflector core 1 in the flared socket 12, (e) an inner sleeve 16 having an inner end 18 closely fitted on an inner end 20 of the deflector core holder 10 and having a leading, lengthwise extending end portion 22 with an enlarged bore and terminating at an intermediate position along the length of the flared socket 12 to form a fluid passage 24 around the deflector core holder 10 for, in operation, directing a jet of atomizing fluid along the outer surface of the flared socket 12 and towards and along the outwardly deflecting surface 2 of the deflector core 1, (f) an outer sleeve 26 mounted at a rear end 28 on the inner sleeve 16 and having a stepped, annular recessed portion 30 at the leading end with the nozzle rim 4 mounted therein and protruding radially inwardly therefrom, a portion 32 of the outer sleeve member 26 having a relatively larger bore diameter than the outside diameter of the inner sleeve 16 and forming therewith a liquid-to-be-atomized passage 34 therearound, for, in operation, conveying liquid-to-be-atomized towards an inner side face 36 of, and inwardly around, the inward protrusion of the nozzle rim 4, (g) means, in the form of a screw threaded collar 38, securing the nozzle rim 4 in the stepped, annular recess portion 30, (h) means, in the form of a plenum chamber 46 and ports such as ports 48, in a rear end of the deflector core holder 10, for delivering atomizing fluid to the fluid passage 24, and (i) means, in the form of arcuate slots, such as arcuate slots 78 and 80 in a flange 76 on the outer sleeve 16, for delivering liquid-to-be-atomized to the liquid-to-be-atomized passage 34.

The nozzle rim 4 has a chamber 40 and is aligned in the annular recessed portion 30 by an annular shaped, locating wedge 42 locating on the chamber 40.

The deflector core holder 10 has a screw threaded bore 44 leading to the plenum chamber 46 from which the ports, such as ports 48, pass fluid to the passage 24. A spigot 50 has a screw threaded portion of the spigot screwed into the threaded bore 44 of the deflector core holder 10. The spigot 50 has a fluid passage 52 for passing fluid to the plenum chamber 46. The spigot 50 has a bulkhead 54 integral therewith and which is in two parts 56 and 58 sealed together by a weld 60 and has a liquid-to-be-atomized passage 62 extending therein. The part 56 is sealed to the inner sleeve 16 by 'O'-ring seals 64 and 66 in annular grooves 68 and 70, respectively, in the part 56. The passage 62 delivers fluid to an annular groove 72 in the part 56.

The inner end 18 of the sleeve 16 is in the form of an enlarged screw threaded collar 74 and end flange 76. The inner end 18 has arcuate, fluid-to-be-atomized slots, two of which are shown and designated 78 and 80, for delivering fluid from the annular groove 72 to the fluid passage 34.

The rear end 28 of the outer sleeve 26 has a screw threaded recess 82 screwed on to the screw threaded collar 74 of the sleeve 16. The end flange 76 has annular, sealing surfaces 84 and 86 for sealing against the 'O'-rings 64 and 66, respectively.

The fluid passage 52 extends through the bulkhead 54 and has an atomizing fluid supply pipe 88 is connected to the bulkhead 54 for delivering atomizing fluid to the fluid passage 52. A liquid-to-be-atomized supply pipe 90 is connected to the bulkhead 54 for delivering liquid-to-be-atomized to the passage 62.

A tubular casing 92 is attached at a leading end to the bulkhead 54 and at a rear end to a casing flange 94. The casing 92 has the pipes 88 and 90 extending therealong the interior thereof. A steam supply pipe 96 extends down the casing 92, with steam escape holes 97 therealong for the escape of steam therefrom into the casing 92, the steam supply pipe 96 terminates with a closed end adjacent the bulkhead 54.

A thermocouple 98 extends along the bore of the pipe 90, for measuring the temperature of the fluid therein, and a thermocouple 100 extends down the bore of the casing 92 for measuring the steam temperature therein.

As shown in FIG. 3, the thermocouple 100 extends through a gland 112. The arm 106 of the T-junction 102 has a steam/condensate outlet pipe 108 sealed thereto by a gland 110. The steam supply pipe 96 extends through the flange 94 and is sealed thereto by a gland 112.

As shown in FIG. 4, the pipe 90 extends through the flange 94 and is connected to a T-junction 114 having liquid-to-be-atomized inlet 116. The thermocouple 98 extends from the T-junction 114 through a gland 118.

The apparatus shown in FIGS. 1 to 4 was primarily designed for use in tests as a liquid mixture fuel atomizer and will be described, in operation, atomizing a de-ashed, pulverized coal liquid mixture fuel using the atomizing air of a conventional oil burner assembly (not shown) where secondary, combustion air is swirled around the atomized fuel.

In operation, with the apparatus arranged as shown in FIGS. 1 to 4, atomizing air is fed along the pipe 88, while the steam is fed along the pipe 96, out of the escape holes 97 and travels back along the casing 96 to exit therefrom along pipe 108. The steam heats the fuel fed along pipe 90 and the air fed along pipe 88 and has been found to improve combustion. The thermocouple 98 was used to monitor the temperature of the fuel at the leading end of the nozzle assembly while the thermocouple 100 was used to monitor the temperature of the steam at this position.

Referring to FIG. 2, the atomizing air from the pipe 88 travels along the passage 52 and passes through the ports, such as 48, into the passage 24 to flow as a jet along the outer surface of the flared socket 12 and along the outwardly deflecting surface 2 through the nozzle orifice 8. At the same time the fuel from the pipe 90 passes into the annular groove 72 into the arcuate slots, such as 78 and 80, to the nozzle orifice 8.

The jet of air, from the passage 34, flowing along the outer surface of the flared socket causes the coal/oil fuel to initially be held as a hollow cone-shaped film against the flared inner surface 6 of the nozzle rim 4 and so there is negligible, if any, contact between the fuel and the flared socket 12. As the hollow cone-shaped film of fuel emerges from the flared inner surfaces 6 of the nozzle rim 4, it is atomized by the jet of air from the passage 34.

Apparatus of the type shown in FIGS. 1 to 4 has been used as an atomizer in wear tests for fuels in the form of No. 6 bunker oil, coal-oil-water and coal-water in a utility burner.

In all of these tests the atomizing fluid was air and/or steam, and the atomizer was fitted into a conventional burner assembly where secondary air was swirled around the atomized fuel as the main combustion air.

The tests used a conventional atomizer having a nozzle of nitrided tool steel.

A coal:oil:water (55:30:15 wt. ratio) mixture was sprayed through both atomizers for 200 hours. The atomizer according to the present invention was shown to be one order of magnitude less susceptible to erosive wear than the conventional nozzle.

FIG. 5 is a graph of the results of the tests showing the total solids discharged (TSD) from the nozzle in lbs. during the test, plotted against a percentage wear parameter (WP%) in the form of a product of a discharge coefficient x area of discharge.

In FIG. 5, designates the results of the tests of the conventional nozzle, and Δ designates the results of the tests of the nozzle according according to the present invention.

Two sizes of the nozzle shown in FIGS. 1 to 4 have been manufactured and tested:

Nozzle 1: nominal capacity, 0.5–2.0 USGPM outside dimensions, 1.9" diam.×2.5" long.

Nozzle 2: nominal capacity, 0.25–1.0 USGPM outside dimensions, 1.25" diam.×2.0" long.

As noted above, the tests have shown the capability of about 4:1 turndown ratio while firing No. 6 oil, coal-oil-water and coal-water fuels.

The following examples form a synopsis of combustion experience with the two nozzle sizes. The combustion trials, given below, were performed in a 14M Btu/hr capacity flame tunnel facility. The combustion assembly was mounted axially within a modified Babcock-Duiker 200 swirl register.

TRIALS (1) An atomizer of the Nozzle 1 size, burning No. 6 oil at a firing rate 14M Btu/hr. Atomizing air usage was 40 SCFM at a pressure of 80 psig. The fuel pressure was 10 psig. At identical delivered fuel flowrates, the invention disclosed here provided a significantly higher firing rate than the conventional nozzle. So much higher that firing had to be terminated in lieu of the high temperature of the refractory lining of the test furnace.

(2) An atomizer of the Nozzle 1 size, burning a coal-oil-water (55:30:15) mixture at a firing rate of 8M Btu/hr. Atomizing air usage was 40SCFM at a pressure of 80 psig. The necessary fuel pressure was 50 psig. The resulting flame was sustained without ignitor assist and resembled an oil flame in appearance.

(3) An atomizer of the Nozzle 1 size, burning a coal-water (70:30) mixture at a firing rate of 9.5M Btu/hr. Atomizing air usage was 35 SCFM at an air pressure of 55 psig. The necessary fuel pressure was 35 psig. The flame envelop was sustained without ignitor assist and resembled a pulverized coal fire's flame in appearance.

(4) An atomizer of the Nozzle 2 size, burning No. 6 oil at a firing rate of 3.2M Btu/hr. Atomizing air usage was 15 SCFM at a pressure of 90 psig. The required fuel pressure was 10 psig. A stable flame with adequate ignition characteristics resulted.

(5) An atomizer of the Nozzle 2 size, burning a coal-oil-water (55:30:15) mixture at a firing rate of 2.4M Btu/hr. Atomizing air usage was 15 SCFM at a pressure of 90 psig. The required fuel pressure was 50 psig. A oil-water flame envelop similar to that realized with Nozzle 1 was achieved.

(6) An atomizer of the Nozzle 2 size, burning a coal-water (70:30) mixture at a firing rate of 2.4M Btu/hr. Atomizing air usage was 20 SCFM at a pressure of 50 psig. The fuel pressure was 35 psig. As was the case with the Nozzle 1 size, the flame appearance was of a pulverized coal fire's nature.

(7) All of the above noted examples of nozzle usage have been duplicated with steam atomization. Similar results were noted indicating no inherent problems in steam atomization.

The nozzle dimensions of the atomizer of the present invention can be adjusted for use with different fuels and for operating at a particular firing rate for a particular fuel merely by inserting shims, 120 and 122 (FIG. 4), of particular thickness to change the fuel loading or the air flow rate.

A preferred included angle for the surface 2 is in the range 60° to 90°.

The atomizer according to the present invention has been shown useful for atomizing Nos. 2 and 6 bunker fuel oils, coal-oil fuels, coal-oil-water fuels, coal-water fuels, and continuous-water-phase coal-water-oil fuels from de-ashed, oil-water agglomerates.

In a different embodiment of the present invention the atomizing air pipe 88, the fuel pipe 90 and the tubular casing 92 are arranged coaxially with the atomizing air pipe 88 innermost. The atomizing air pipe 88 is sealed by a packing to the flange 94 and is slidable longitudinally therethrough. The deflector core 1 and deflector core holder 10 are mounted on the leading end of the atomizing air pipe 88 to be slidable therewith. The rear end of the atomizing air pipe 88 has a micrometer thread on its external surface with a graduated micrometer thimble assembly screwed thereon, so that the atomizing pipe 88 may be moved longitudinally by the graduated micrometer thimble to finely adjust the cross-sectional area of the flared, atomizing nozzle orifice 8 by moving the deflector core 1 relative to the nozzle rim 4.

We claim:

1. A wear resistant, atomizing nozzle assembly comprising:

(a) an outwardly diverging, frustum of a cone shaped, deflector core of a wear resistant ceramic material, said deflector core having an outwardly diverging surface, an outer portion of the diverging surface of the deflector core forming an outwardly deflecting surface for a liquid-to-be-atomized, (b) a nozzle rim of a wear resistant ceramic material, the rim having an inward protrusion with outwardly flared inner surface encircling the diverging surface of the deflector core to form therewith a flared, atomizing nozzle orifice, (c) a deflector core holder having a flared socket at a leading end, the flared socket having an inner portion of the deflector core closely fitting and aligned therein, the flared socket, in operation, guiding atomizing fluid towards and along the outwardly deflecting surface of the deflector core, (d) securing means securing the deflector core in the flared socket, (e) an inner sleeve having an inner end closely fitted on an inner end of the deflector core holder and having a leading, lengthwise extending end portion with an enlarged bore and terminating at an intermediate position along the length of the flared socket to form a fluid passage around the deflector core holder for, in operation, directing a jet of atomizing fluid along the outer surface of the flared socket and towards and along the outwardly deflecting surface of the deflector core, (f) an outer sleeve mounted at a rear end of the inner sleeve and having a stepped, annular recessed portion at the leading end with the nozzle rim mounted therein and protruding radially inwardly therefrom, a portion of the outer sleeve member having a relatively larger bore diameter than the outside diameter of the inner sleeve and forming therewith a liquid-to-be-atomized passage therearound, for, in operation, conveying liquid-to-be-atomized towards an inner side face of, and inwardly around, the inward protrusion of the nozzle rim, (g) means securing the nozzle rim in the stepped, annular recess, (h) means for delivering atomizing fluid to the fluid passage, and (i) means for delivering liquid-to-be-atomized to the liquid-to-be-atomized passage.

2. A nozzle assembly according to claim 1, further comprising a bulkhead connected to the inner and outer sleeves and having passages therethrough for passing atomizing fluid to the means for delivering atomizing fluid and liquid-to-be-atomized to be the means for delivering liquid-to-be-atomized, a tubular casing connected to the bulkhead and extending rearwardly therefrom, said tubular casing having a rear end, a casing flange sealing the rear end of the tubular casing, an atomizing fluid supply pipe extending through the casing flange along the casing interior and connected to the bulkhead to deliver fluid to the atomizing passage extending therethrough, and a liquid-to-be-atomized supply pipe extending through the casing flange along the casing interior and connected to the bulkhead to deliver liquid to the liquid-to-be-atomized passage extending therethrough.

3. A nozzle assembly according to claim 2, further comprising a steam supply pipe, with steam escape holes therealong for the escape of steam therefrom into the casing interior, the steam supply pipe extending through the casing flange and terminating with a closed end adjacent the bulkhead, and steam/condensate outlet means is attached to the casing flange for the removal of steam/condensate from the casing interior.

4. A nozzle assembly according to claim 1 wherein the deflector core has an included angle in the range 60° to 90°.

* * * * *